US011510009B2

(12) United States Patent
Soofer

(10) Patent No.: US 11,510,009 B2
(45) Date of Patent: Nov. 22, 2022

(54) DECORATIVE GARDEN FOUNTAIN WITH A SPEAKER

(71) Applicant: Alpine Corporation, Los Angeles, CA (US)

(72) Inventor: Sohrab Robby Soofer, Beverly Hills, CA (US)

(73) Assignee: Alpine Corporation, City of Industry, CA (US)

( * ) Notice: Subject to any disclaimer, the term of this patent is extended or adjusted under 35 U.S.C. 154(b) by 279 days.

(21) Appl. No.: 16/988,208

(22) Filed: Aug. 7, 2020

(65) Prior Publication Data

US 2021/0354165 A1 Nov. 18, 2021

Related U.S. Application Data

(60) Provisional application No. 63/055,883, filed on Jul. 23, 2020, provisional application No. 63/026,720, filed on May 18, 2020.

(51) Int. Cl.

| | |
|---|---|
| ***H04R 9/06*** | (2006.01) |
| ***H04R 1/02*** | (2006.01) |
| ***B05B 17/08*** | (2006.01) |

(52) U.S. Cl.

CPC ..... *H04R 9/06* (2013.01); *B05B 17/08* (2013.01); *H04R 1/028* (2013.01)

(58) Field of Classification Search

CPC ..... B05B 17/08; H04R 1/028; H04R 9/06

See application file for complete search history.

(56) References Cited

U.S. PATENT DOCUMENTS

| | | | | |
|---|---|---|---|---|
| 5,234,728 | A * | 8/1993 | Chiang | B44F 1/00 40/406 |
| 5,916,030 | A * | 6/1999 | Warner | A63J 5/04 472/64 |
| 6,206,298 | B1 | 3/2001 | Ting | |
| 9,278,369 | B2 * | 3/2016 | Lee | H04R 1/028 |
| D810,721 | S | 2/2018 | Soofer | |
| 10,231,039 | B2 | 3/2019 | Soofer | |
| D897,989 | S | 10/2020 | Soofer | |
| 2007/0053174 | A1 | 3/2007 | Lin | |

(Continued)

FOREIGN PATENT DOCUMENTS

| | | |
|---|---|---|
| CN | 203 352 491 U | 12/2003 |
| CN | 203 235 612 U | 10/2013 |
| CN | 209 837 796 U | 12/2018 |

OTHER PUBLICATIONS

Search Report for European Application No. 21174444.6 dated Oct. 4, 2021 (9 pages).

https://www.homedepot.com/p/Alpine-Corporation-40-in-Tall-Outdoor-4-Tier-Rock-Water-Fountain-with-LED-Lights-W[N316/206049793?source=shoppingads&locale=en-US&mtc=Shopping-B-F_D28O-G-D28O-28_9_PLANTERS-NA-NA-NA-SMART-NA-NA-SMART_SHP&cm_mmc=Shopping-B-F_D28O-G-D28O-28_9_PLANTERS-NA-NA-NA-SMART-NA-NA-.

*Primary Examiner* — Arman B Fallahkhair
(74) *Attorney, Agent, or Firm* — Payam Moradian

(57) ABSTRACT

Provided is a portable decorative fountain, comprising: a) a body with one or more cavities for collection of water, and one or more openings configured for passage of sound from inside of the body to outside of the body; b) a pump for pumping the water from the cavity in an upward direction; c) a conduit for carrying water that is pumped by the pump; and d) a speaker for playing sound through one or more openings on the body; wherein the fountain can be operated with or without the speaker playing sound.

11 Claims, 8 Drawing Sheets

(56) References Cited

U.S. PATENT DOCUMENTS

| | | | | |
|---|---|---|---|---|
| 2007/0084945 | A1* | 4/2007 | Wei | F21S 8/00 239/18 |
| 2013/0294952 | A1* | 11/2013 | Caprathe | F04D 25/0673 417/423.14 |
| 2015/0231661 | A1 | 8/2015 | Lee et al. | |
| 2016/0212514 | A1 | 7/2016 | Lee | |
| 2017/0230739 | A1* | 8/2017 | Soofer | H04R 3/00 |
| 2019/0041051 | A1* | 2/2019 | Wijaya | H05B 47/19 |

* cited by examiner

DECORATIVE GARDEN FOUNTAIN WITH A SPEAKER

CROSS-REFERENCE

The present application claims the benefit of U.S. provisional patent application No. 63/026,720, filed on May 18, 2020, and U.S. provisional patent application No. 63/055,883, filed on Jul. 23, 2020, which are incorporated herein by reference in its entirety.

BACKGROUND SECTION OF THE INVENTION

Decorative garden fountains are typically placed in a garden for aesthetics. The existing decorative garden fountains have limited functionalities. There is a need in the prior art for decorative fountains that are aesthetic and have additional functionality.

SUMMARY SECTION OF THE INVENTION

Provided is a portable decorative fountain, comprising: a) a portable body with one or more cavities for collection of water, and one or more openings configured for passage of sound from inside of the body to outside of the body; b) a pump for pumping water from at least one of the cavities in an upward direction; c) a conduit for carrying water that is pumped by the pump; and d) a speaker for playing sound through one or more openings on the body; wherein the fountain can be operated with or without the speaker playing sound. The body can have a height of one foot to six feet, weight of 1 kg to 200 kg, and a longest width from bottom center of the housing that is between 1 foot to three feet. The fountain can be a cascading fountain with a plurality of cavities. The cavity can have a light placed under where the water collects. The lights can change in respond to a different sound coming from the speaker. The speaker can be incorporated on a side of the fountain in relation to a lowest cavity where water collects. The speaker can be less than 2 feet elevated, facing outward. The speaker can be placed at top of the fountain. The further comprising a waterproof casing where the speaker is placed. There can be a cover for the casing with the openings, wherein the cover makes a portion of the body of the fountain and is visible from outside of the fountain. The housing can comprise two more rocks, one of the rocks of the housing having openings for travel of sound.

Provided is a portable decorative fountain, comprising: a) a portable body with at least two cavities configured in a cascading fashion, and the body having one or more openings configured for passage of sound from inside of the body to outside of the body, wherein the body has a height of one foot to six feet, weight of 1 kg to 200 kg, and a longest width from bottom center of the housing that is between 1 foot to three feet; b) pump for pumping water from at least the cavity position at a lowest level in an upward direction; c) a conduit for carrying water that is pumped by the pump; and d) a speaker for playing sound through one or more openings on the body; wherein the fountain can be operated with or without the speaker playing sound. The lowest cavity (from the center of the portion of the cavity that is visible (not blocked by rocks)) can define a front of the body, and the speaker is placed on a side. The waterproof casing and cover where the speaker is placed, wherein the cover makes a portion of the body of the fountain and is visible from outside of the fountain.

Provided is a portable decorative fountain, comprising: a) a portable body with at least two cavities configured in a cascading fashion, the body having an opening; b) a pump for pumping water from at least the cavity position at a lowest level in an upward direction; c) a conduit for carrying water that is pumped by the pump; d) a speaker; e) a waterproof casing for placing the speaker inside of the body; f) a cover configured to fit over the casing and cover the opening of the body, the cover having a plurality of its own openings, the cover's openings configures to allow sound from the speaker to travel from one side of the cover to another side of the cover; wherein the fountain can be operated with or without the speaker playing sound.

DETAILED DESCRIPTION OF THE INVENTION

Figure 1:
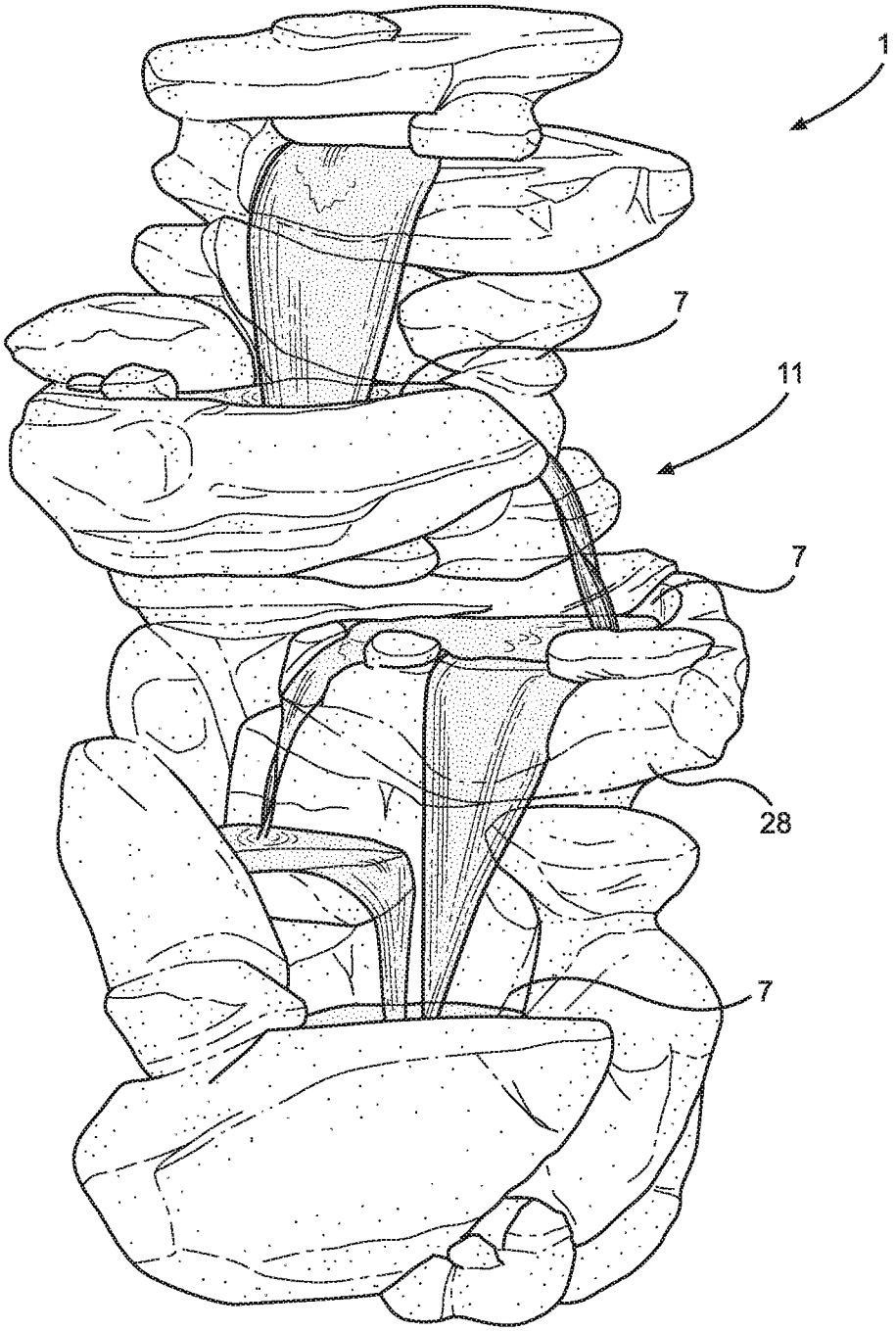
FIG. 1 illustrates a cascading fountain with a speaker on its side (the speaker is illustrated in FIG. 2).

Provided is a decorative fountain 1 with a speaker 4. The decorative fountain 1 can be suitable for placement in a garden. The decorative fountain 1 can have one or more components including a body/housing 28, a cavity 7 (in form of ponds as illustrated) for collection of water, a pump 25, and a conduit 29 for moving the water upward from the lowest positioned cavity 7 through the force generated by the pump 25.

The fountain 1 can have one or more cavities 7 (ponds), such as 1, 2, 3, 4, or 5 cavities 7 for collection of water. As illustrated, the fountain has three larger cavities 7 and a smaller cavity. The fountain 1 can be a cascading fountain (as illustrated in FIG. 1), where water from one pond falls into another fond that is positioned lower. Each cavity 7 (ponds), can have a light source 12 inside, which illuminates through the water in each cavity 7 (pond). The light source 12, which can be an LED (Light Emitting Diode) light, can be a single colored light, or a multi-colored light. A transparent (waterproof) window 18 can be placed over the light source 12 on the bottom of one or more of the cavities 7 (ponds).

The speaker 4 can be placed on the bottom of the fountain 1, facing outward. The outwardly speaker 4 can be placed inside of one of the faux rocks 2 of the fountain 1. The fountain 1 can comprise two or more faux rocks 2 on the bottom, which a speaker 4 grill placed on one of the rocks 2 or openings 3 cut into the rock 2. The fountain 1 can have a housing that gives the impression of presence of plurality of rocks (such as 10 to 30 rocks), which one of the faux rocks 2 turned into a speaker 4.

The fountain/speaker housing 28 can be made from a synthetic material such as plastic. The fountain/housing 1/28 can have a flat bottom for placement of the housing on a surface. The fountain/housing 1/28 can be one foot to four feet tall (or two feet to six feet tall) (at tallest point), and have a length and and/or width from the bottom center of the housing that is between 1 foot to three feet (at longest length). The inside of the fountain 1 can be hollow, with the rocks just representing the shape of the wall of the housing 28, and made up of a piece of plastic that looks like a rock.

The housing can have a plurality of irregularly shaped openings that are configured to allow sound that is produced by the speaker 4 to travel from the inside of the housing 28 to the outside of the housing 28. The speaker 4 can be placed in a waterproof casing 16 and sealed with the casing cover 17.

The portion of the speaker 4 that produces sound (diaphragm) faces the openings of the housing. The plurality of openings 3 can be spaced apart from each other in such arrangement that forms a circle. There can be about 10 to about 20 openings 3. In one embodiment, in between the housing 28 and the face of the speaker 4, optionally there can be a sealing ring, and a speaker grill.

In the back or side of the housing 28 there can be electronic access window 13, which can be removed to access the speaker 4, junction 9, and wires 8 and 11. A circuit board with a processor can be placed on the inside of the housing 28. The main processor 19 on the circuit board can be in electronic communication with a port, such as a USB port 22, which can be accessed from outside of the housing 28 through an opening in the cover 17. There can also be a switch for turning on and off the speaker which can be accessed from outside of the housing 28. The main processor 19 can further be in communication with a processor configured for wireless communication, such as Bluetooth (Bluetooth chip) 21. In one embodiment, the fountain 1 can also have a back-up battery with or without a solar panel which only powers the speaker 4 independent of the pump 25.

FIG. 1 illustrates a cascading garden fountain 1, with the housing 28. In the cascading fountain 1 of FIG. 1, there are at least three cavities 7 (ponds) where the water collects. A pump 25 inside the fountain pumps the water to the top of the fountain through conduit 29, and then the water cascades down from one cavity 7 to another. The fountain 1 of FIG. 1 is comprised of a housing 28 that gives the impression of being made from a plurality of rocks of different shapes and sizes arranged to allow for a cascading fountain with multiple cavities 7.

Figure 2:
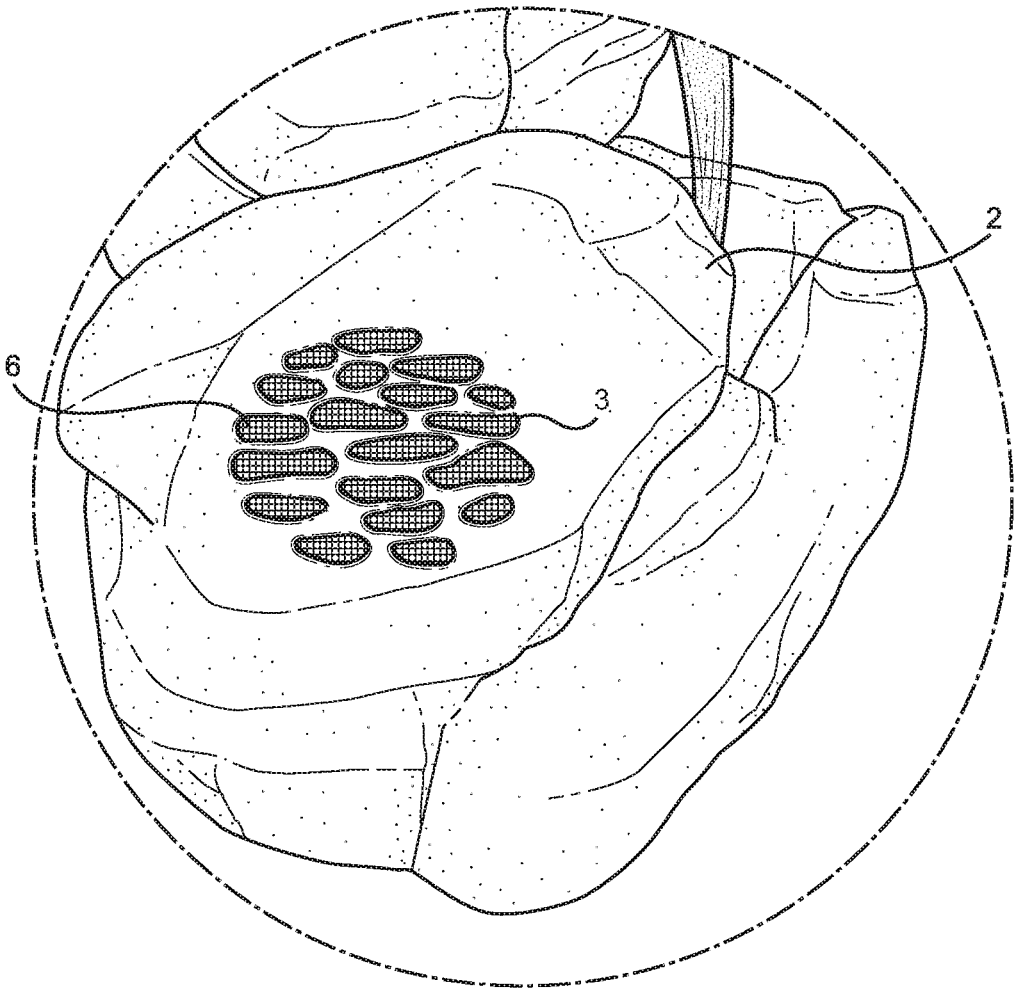
FIG. 2 illustrates a speaker placed on the side of the fountain of FIG. 1.

FIG. 2 illustrates placement of a speaker inside of faux rock 2 of the fountain on side of the fountain in relation to the front side of the fountain where the water flows. The speaker 4 is placed below two feet in height in this embodiment. As illustrated, the faux rock 2 where the speaker 4 is placed in above a smaller faux rock that sits on the ground. The speaker 4 in this embodiment is placed the side of the fountain in relation to the cavity 7 where the water collects on bottom of the fountain 1. The grill 6 can be placed in front of speaker 4 but behind opening 3. The openings 3 are part of casing cover 17. The casing cover 17 can be blended into the body to give the impression that it is part of the body.

Figure 3:
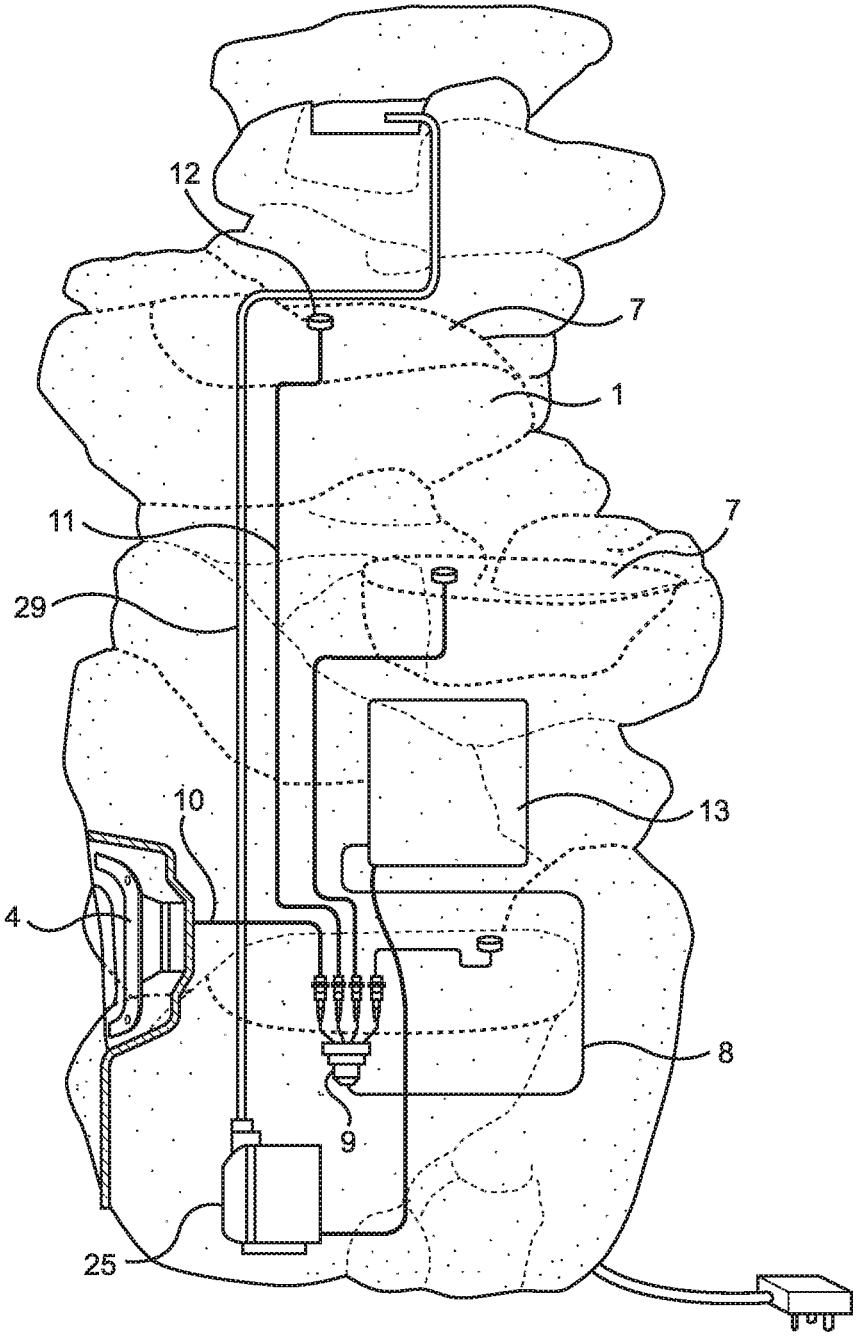
FIG. 3 illustrates internal electrical components of the fountain of FIG. 1.

FIG. 3 illustrates the electronic components of the water fountain 1. Illustrated in this drawing is the speaker 4 placed on the side of the fountain. The speaker 4 is connected with a wire 10 to the junction 9. Additional wires 11 go to the light sources 12. A light source 12 can be placed on the bottom of each cavity 7. A power cord 8 can bring power from an outside source of energy, typically an electric plug. The power cord can leave the fountain through access window 13.

Figure 4:
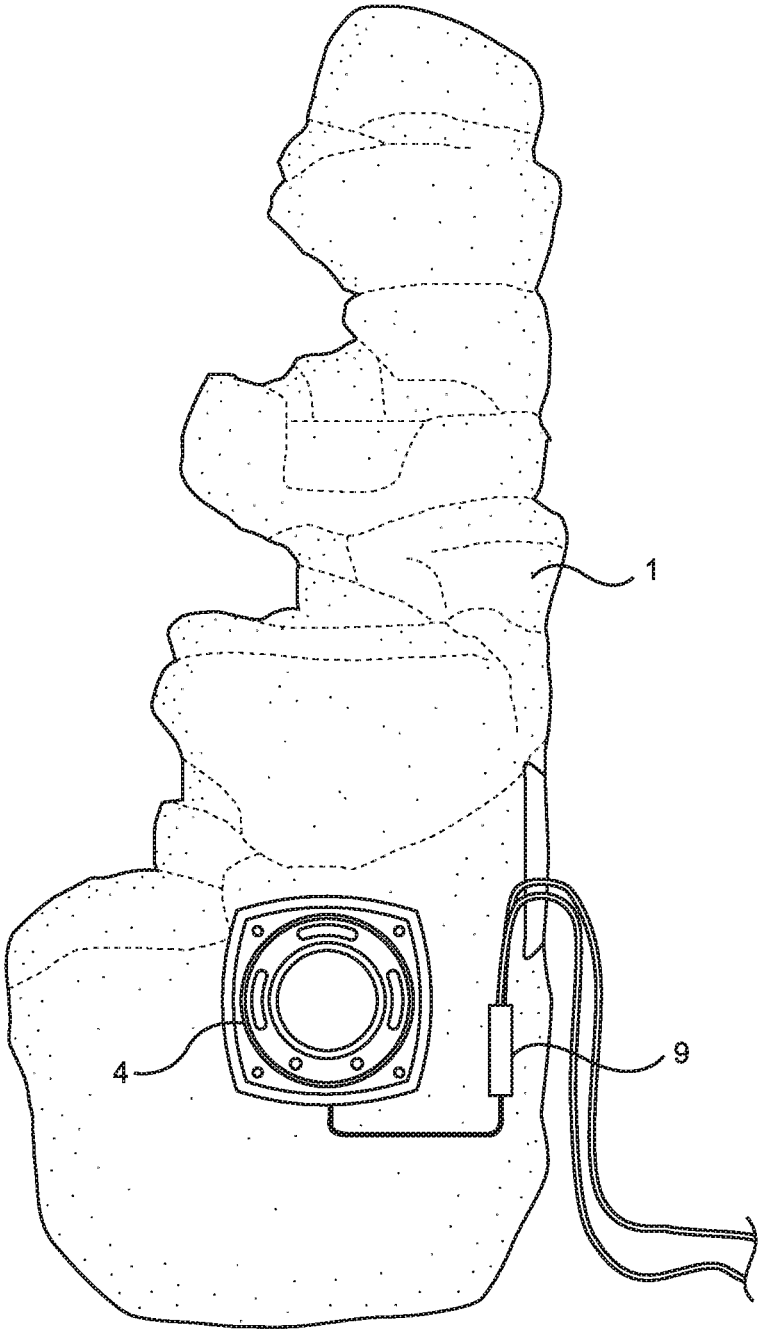
FIG. 4 illustrates a side view of the fountain with the speaker placed on the side.

FIG. 4 illustrates a side view of the fountain 1. Illustrated in this figure is speaker 4 that is placed on the bottom side of the fountain 1 and the wiring from the speaker 4.

Figure 5:
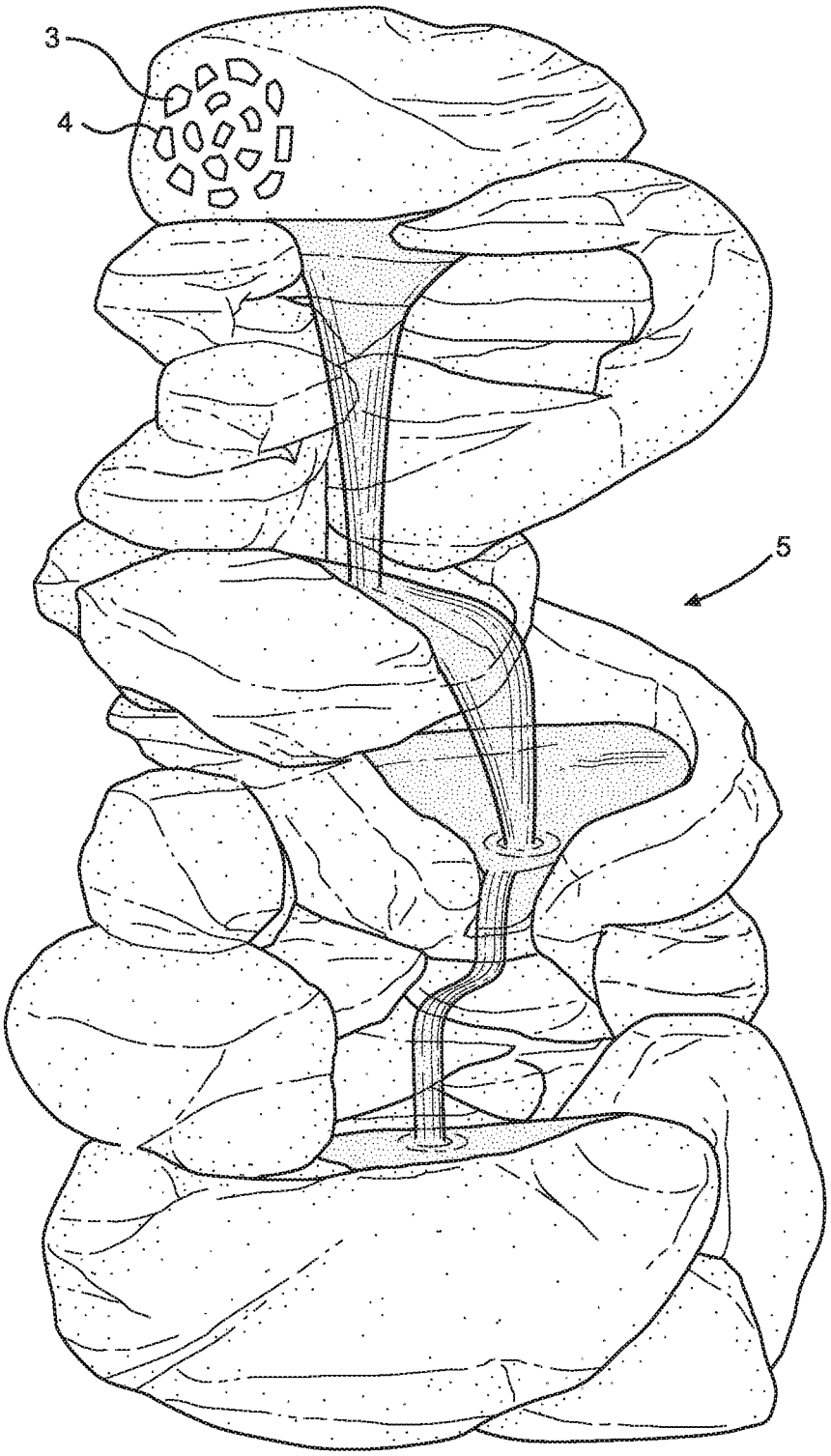
FIG. 5 illustrates a fountain where the speaker is placed on the top of the fountain.

FIG. 5 illustrates fountain 5 with a speaker 4 on top of the fountain 5. The fountain 5 can be made from a plurality of rocks of different sizes, such as having the look of 10-30 faux rocks, with a speaker 4 placed inside a faux rock all the way on top of the fountain 5.

Figure 6:
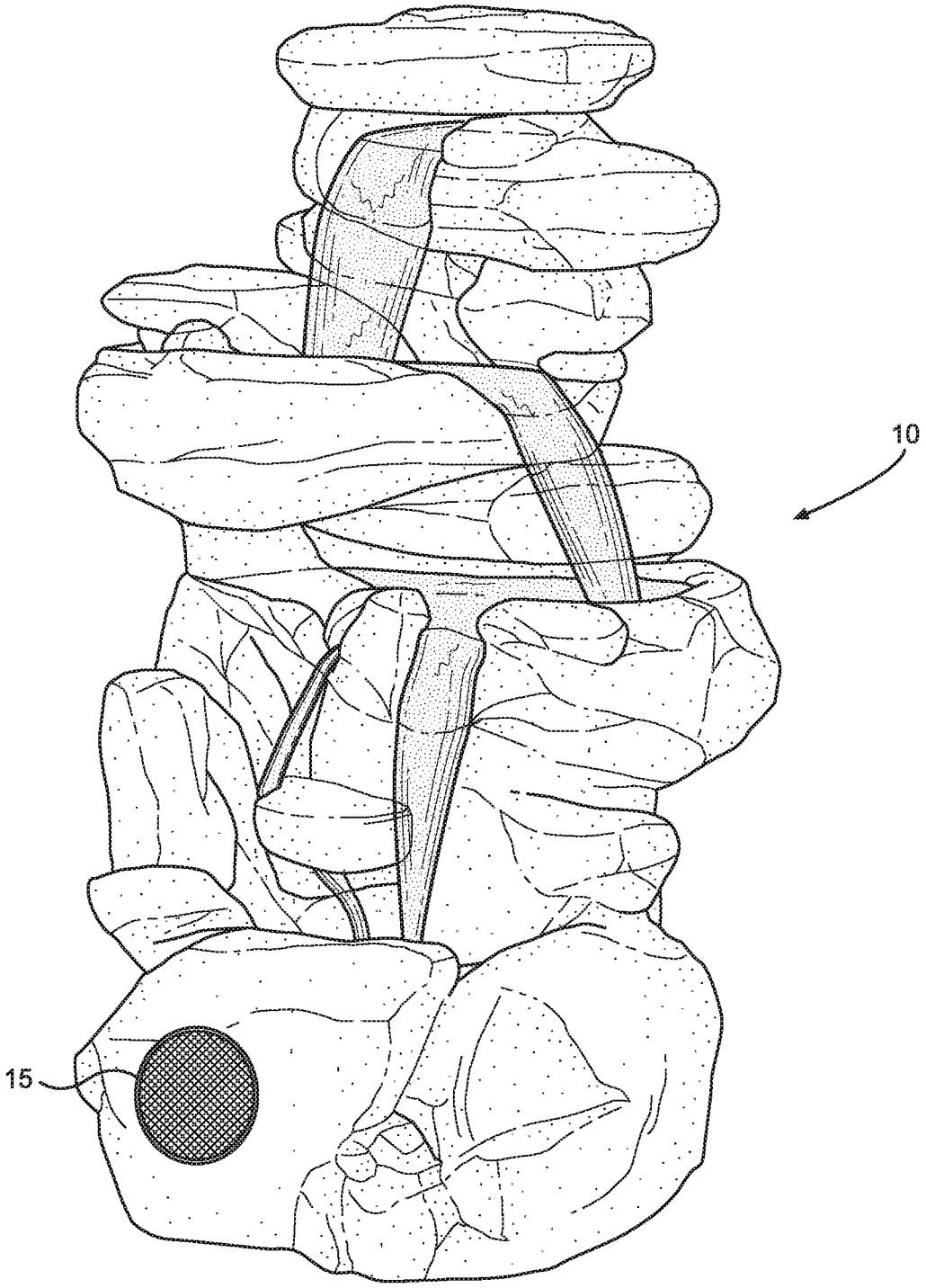
FIG. 6 illustrates a fountain with a speaker having a grill.

FIG. 6 illustrates the fountain 10, which is the same as fountain 1 except that it uses a grill 15 instead of openings 3 in the rock.

Figure 7:
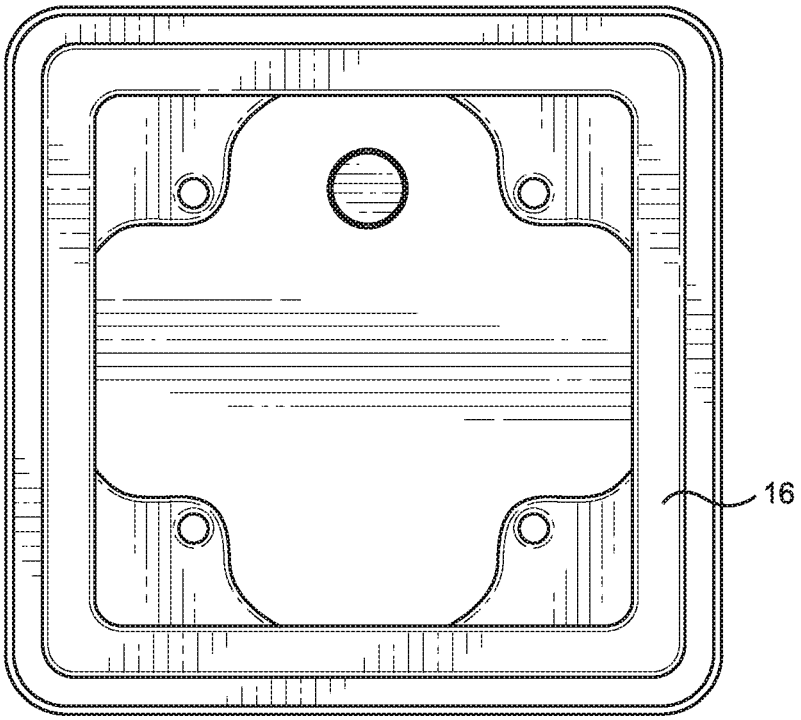
FIG. 7 illustrates a waterproof casing for placement of the speaker.

FIG. 7 illustrates a waterproof casing 16. Speaker 4 is placed inside of waterproof casing 16, which is placed inside of the faux rock of the fountain 1.

Figure 8:
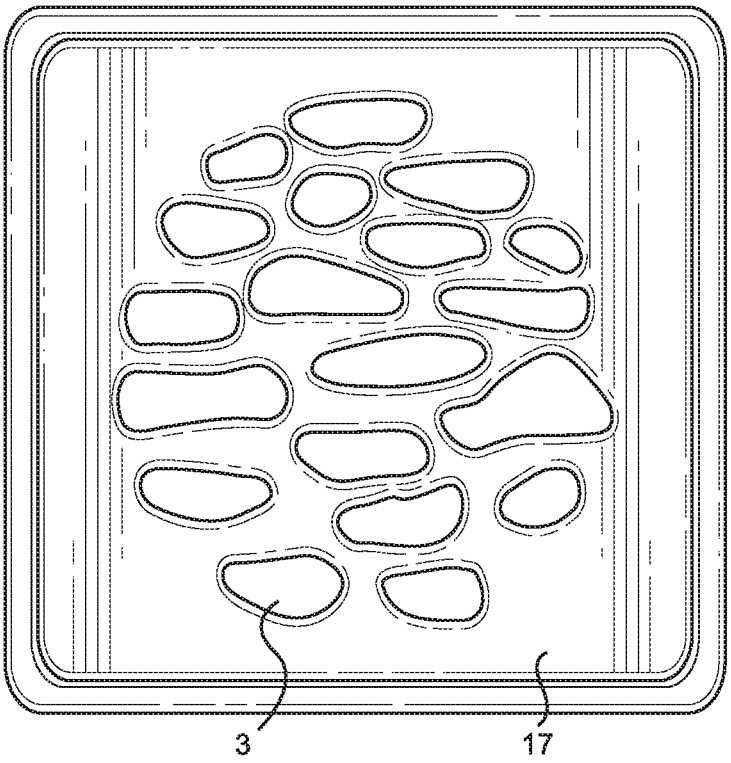
FIG. 8 illustrates a casing cover with a plurality of openings for placement on the cover of FIG. 7.

FIG. 8 illustrates a casing cover 17 that is placed on the casing 16, which houses the speaker 4. Casing cover 17 has a plurality of openings 3, and forms an outer portion of the fountain housing 28. Casing cover 17 can be painted the same as the rest of the fountain.

Figure 9:
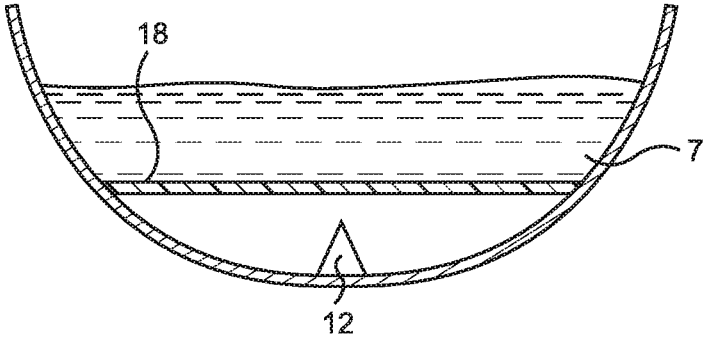
FIG. 9 illustrates a cavity (pond) where water collects, with a light placed on the bottom of the pond.

FIG. 9 illustrates a cavity 7 (pond) of the fountain 1 where the water collects. A light 12 can be placed under a transparent window 18 on the bottom of each cavity. Alternatively, the light 12 can be waterproof and not need a window.

Figure 10:
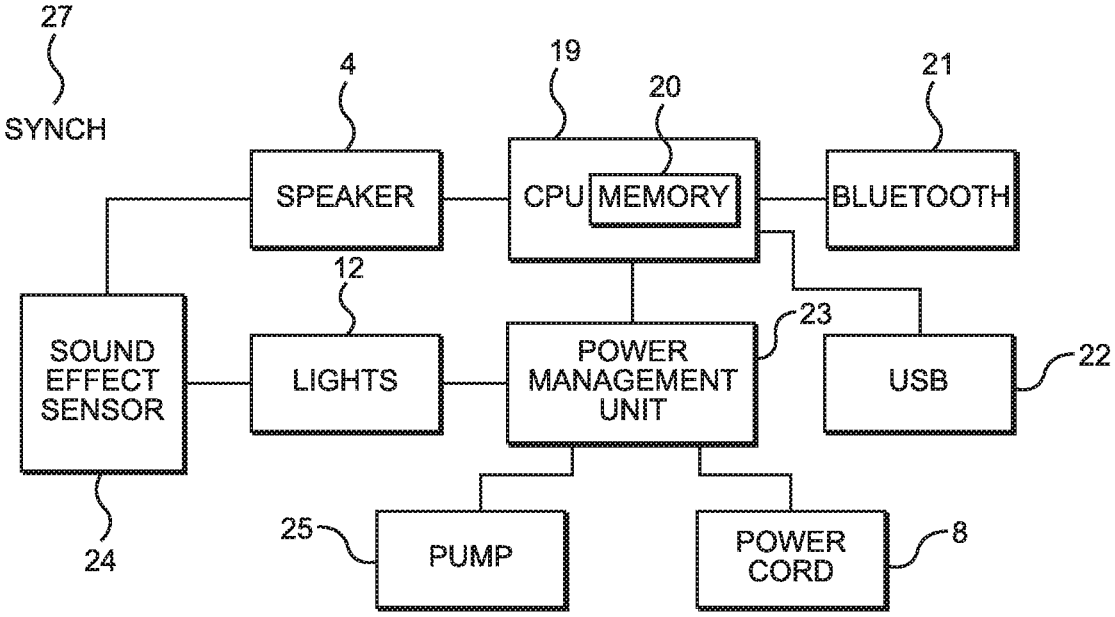
FIG. 10 illustrates various electronic components of the fountain.

FIG. 10 illustrates various electronic components of the fountains, such as speaker 4, CPU (Central Processing Unit) 19, memory 20, Bluetooth chip 21, light source 12, power management unit 23, USB port 22, pump 25, and power exchange 26.

CPU (Central processor unit) 19 can be a microcontroller with internal memory 20. CPU 19 can be in communication with speaker through driver. CPU 19 can also be in communication with a Power Management Unit 23 can control and monitor the electrical current. CPU 19 can also be in communication with Bluetooth chip 21 configured for wireless communication with a smart phone or other electronic device of a user. The user would make a wireless communication protocol, such as by Bluetooth chip 21, to pair the speaker with a user's electronic device, such as a mobile or smart phone, a tablet computer, or a dedicated music player. The user can then play the contents (such as songs) over the loudspeaker. After receiving a wireless signal, the speaker system forms connection (pairs) with the user's device. The speaker 4 then receives audio content from the user's device. The audio content can be played as a live stream (with a minimal buffer as needed) or stored in memory 20 and played overtime.

Alternatively, a wired connection can be made with the port (such as the USB Port 22) to play the audio content (songs) and/or to charge the user's electronic device. The audio content can be uploaded from a storage device like a flash drive into the speaker's memory and played over the speaker 4 overtime.

The lights 12 can be synchronized with the sound coming from the speaker 4 by using for example a sound effect sensor 24. The light 12 can change in color and/or lumens/intensity depending on the characteristics of the sound produced by the speaker 4.

REFERENCES

1. Fountain
2. Rock

3. Openings
4. Speaker
5. Fountain with speaker on top
6. Grill
7. Cavity
8. Power cord
9. Junction box
10. Fountain with grill speaker
11. Wire to LED Light
12. Light Source (typically LED)
13. Access Window
15. Grill
16. Waterproof casing
17. Casing Cover
18. Transparent window
19. CPU
20. Memory
21. Bluetooth
22. USB port
23. Power Management Unit (PMU)
24. Sound Effect Sensor
25. Pump
26. Power Exchange
27. Synchronization
28. Body/Housing
29. Conduit

What is claimed is:

1. A portable decorative fountain comprising: a) a portable body shaped like rocks and having three or more cavities in different heights for collection of water and configured in a cascading fashion, water flowing from one cavity to another, and one or more openings in the rocks configured for passage of sound from inside of the body to outside of the body, wherein at least one of the cavities has a light source placed under where the water collects; b) a pump for pumping water from at least one of the cavities in an upward direction; c) a conduit for carrying water that is pumped by the pump; and d) a speaker for playing sound through the one or more openings on the body; e) a cover with the one or more openings, wherein the cover makes a portion of the body of the fountain and is visible from outside of the fountain; wherein the fountain can be operated with or without the speaker playing sound, wherein sound from the speaker travels to outside of the fountain through the openings, wherein light emitted from the light source changes in response to different sounds coming from the speaker.

2. The portable decorative fountain of claim 1, further comprising a waterproof casing where the speaker is placed.

3. The portable decorative fountain of claim 2, wherein the cover being for the waterproof casing.

4. The portable decorative fountain of claim 1, wherein the body has a height of one foot to six feet, weight of 1 kg to 200 kg, and a longest width from bottom center of the housing that is from 1 foot to three feet.

5. The portable decorative fountain of claim 1, wherein the speaker is incorporated on a side of the fountain in relation to a lowest cavity where water collects.

6. The portable decorative fountain of claim 1, wherein the speaker is less than 2 feet elevated from a ground, facing outward.

7. The portable decorative fountain of claim 1, wherein the speaker is placed at top of the fountain.

8. A portable decorative fountain comprising: a) a portable body shaped like rocks with at least three cavities at different heights configured in a cascading fashion, a light source on an inside of at least one of the cavities, and the body having one or more openings configured for passage of sound from inside of the body to outside of the body, wherein the body has a height of one foot to six feet, weight of 1 kg to 200 kg, and a longest width from bottom center of the housing that is between 1 foot to three feet b) a pump for pumping water from at least the cavity position at a lowest level in an upward direction; c) a conduit for carrying water that is pumped by the pump; and d) a speaker for playing sound through the one or more openings on the body; e) the one or more openings being on one of the rocks forming a portion of the body of the fountain, the one or more openings being visible from outside of the fountain, wherein the fountain can be operated with or without the speaker playing sound, wherein sound from the speaker travels to outside of the fountain through the openings, wherein light emitted from the light source changes in response to different sounds coming from the speaker.

9. The portable decorative fountain of claim 8, wherein the lowest cavity defines a front of the body, and the speaker is placed on a side.

10. The portable decorative fountain of claim 8, further comprising a waterproof casing and cover where the speaker is placed, wherein the cover makes a portion of the body of the fountain and is visible from outside of the fountain.

11. A portable decorative fountain comprising: a) a portable body in shape of rocks with an opening and at least three cavities at different heights configured in a cascading fashion, wherein water falls from one cavity to another cavity; a light source on an inside of at least one of the cavities; b) a pump for pumping water from a bottom most cavity of the three cavities upward to a position above another one of at least the three cavities; c) a conduit for carrying water that is pumped by the pump; d) a speaker; e) a waterproof casing for placing the speaker inside of the body; and f) a cover configured to fit over the casing and cover the opening of the body, the cover having a plurality of its own openings, the cover's openings configured to allow sound from the speaker to travel from inside the body to outside of the body; wherein the fountain can be operated with or without the speaker playing sound; wherein light emitted from the light source changes in response to different sounds coming from the speaker.

* * * * *